US008269687B2

(12) United States Patent
Lindmark et al.

(10) Patent No.: US 8,269,687 B2
(45) Date of Patent: Sep. 18, 2012

(54) DUAL BAND ANTENNA ARRANGEMENT

(75) Inventors: Bjorn Lindmark, Stockholm (SE); Jesper Uddin, Stockholm (SE)

(73) Assignee: Powerwave Technologies Sweden AB, Kista (SE)

( * ) Notice: Subject to any disclaimer, the term of this patent is extended or adjusted under 35 U.S.C. 154(b) by 249 days.

(21) Appl. No.: 12/301,999

(22) PCT Filed: May 22, 2007

(86) PCT No.: PCT/SE2007/000497
§ 371 (c)(1),
(2), (4) Date: Jul. 28, 2010

(87) PCT Pub. No.: WO2007/136333
PCT Pub. Date: Nov. 29, 2007

(65) Prior Publication Data

US 2010/0283702 A1 Nov. 11, 2010

(30) Foreign Application Priority Data

May 22, 2006 (SE) ..... 0601136

(51) Int. Cl.
*H01Q 21/00* (2006.01)
*H01Q 21/12* (2006.01)
*H01Q 21/08* (2006.01)

(52) U.S. Cl. ..... 343/810; 343/824; 343/893; 343/812

(58) Field of Classification Search ..... 343/810
See application file for complete search history.

(56) References Cited

U.S. PATENT DOCUMENTS

| | | | | |
|---|---|---|---|---|
| 6,211,841 | B1 | 4/2001 | Smith et al. | 343/813 |
| 6,333,720 | B1 | 12/2001 | Göttl et al. | |
| 6,943,732 | B2 * | 9/2005 | Gottl et al. | 343/700 MS |
| 7,050,005 | B2 | 5/2006 | Gottl et al. | 343/700 |
| 2002/0140618 | A1 | 10/2002 | Plet et al. | |
| 2002/0171601 | A1 * | 11/2002 | Puente Baliarda | 343/893 |
| 2004/0051677 | A1 | 3/2004 | Göttl | |
| 2004/0108956 | A1 | 6/2004 | Gottl et al. | 343/700 |

(Continued)

FOREIGN PATENT DOCUMENTS

FR 2 863 110 6/2004

(Continued)

OTHER PUBLICATIONS

PCT Written Opinion and citation listing from International Search Report for International Application No. PCT/SE 2007/000497 dated Jun. 20, 2007.

*Primary Examiner* — Trinh Dinh
(74) *Attorney, Agent, or Firm* — OC Patent Law Group

(57) ABSTRACT

The present invention relates to an antenna arrangement comprising a first and third set of antenna elements, being arranged as a first and third column and aligned along a first and third symmetry axis, respectively, each column comprising elements being operative in a first frequency band (f1) and elements being operative in a second frequency band (f2). The antenna arrangement further comprises a second set of antenna elements, being arranged as a second intermediate column along a second symmetry axis, said second symmetry axis being parallel to said first and third symmetry axes, and being operative in said second frequency band (f2), wherein the ratio of said second center frequency (f2) to said first center frequency (f1) is in the range 1.5 to 3. The distance between said first and third symmetry axes is less than or equal to 0.6 times the wavelength of said first center frequency (f1), and the distance between said second and said first and third symmetry axis, respectively, is less than or equal to 0.6 times the wavelength of said second center frequency (f2).

17 Claims, 3 Drawing Sheets

U.S. PATENT DOCUMENTS

| | | | | |
|---|---|---|---|---|
| 2004/0145526 | A1* | 7/2004 | Puente Baliarda et al. | 343/700 MS |
| 2004/0164892 | A1 | 8/2004 | Shinoda et al. | 342/107 |
| 2004/0178964 | A1* | 9/2004 | Gottl et al. | 343/797 |

FOREIGN PATENT DOCUMENTS

| | | | |
|---|---|---|---|
| GB | 2 023 939 | A | 5/1979 |
| WO | WO 2004/051796 | A1 | 6/2004 |

* cited by examiner

DUAL BAND ANTENNA ARRANGEMENT

RELATED APPLICATIONS

This application is a 371 of PCT/SE2007/000497 filed May 22, 2007, which claims priority under 35 U.S.C. 119 from SWEDEN 0601136-5 filed on May 22, 2006, the contents of which are incorporated herein by references.

FIELD OF THE INVENTION

The present invention relates to an antenna arrangement for receiving and/or transmitting electromagnetic signals in at least two spaced-apart frequency bands, especially for mobile communication systems, as defined in the preamble of claim 1.

BACKGROUND OF THE INVENTION

Antenna arrays are commonly used for transmitting and receiving RF (Radio Frequency) signals in mobile communication systems and are, in such communication, normally dedicated to a single frequency band or sometimes two or more frequency bands. Single frequency band antennas have been used for a long time and normally include a number of antenna elements arranged in a vertical column. A second column of antenna elements needs to be added next to the first column if a network operator decides to add another frequency band using single frequency band antennas.

Due to the rather substantial space requirements of single band columns of antenna elements, and since such an arrangement may be sensitive to interference between the RF signals in the different frequency bands, dual band antennas (or multiple band antennas, such as triband antennas) have been disclosed. One such prior art arrangement 10 is schematically disclosed in FIG. 1. Two types of antenna elements 11, 12 are arranged alternatively in a column, and aligned along a symmetry axis. A first antenna element 11 is a dual band antenna element which operates in two different frequency bands $FB_1$ and $FB_2$ using first 11' and second 11" elements, respectively. A second antenna element 12 is an antenna element, which operates in only one frequency band $FB_2$. Although this solution has the drawback that the frequency bands $FB_1$ and $FB_2$ will couple to each other due to the closeness of the parts making up the antenna element, space savings often compensate for these drawbacks. Due to the said drawbacks, however, this kind of configuration is most suitable when the frequency bands are widely separated, for example when the centre frequency of $FB_2$ is approximately twice the centre frequency of $FB_1$.

This kind of dual band antennas, however, are useful when an antenna arrangement is to be used for azimuth control. Such an antenna arrangement matrix 20 is disclosed in FIG. 2. The arrangement 20 comprises two parallel dual band columns 21, 23 of the kind described in FIG. 1. Between said columns 21, 23 is arranged a column 22, parallel to the columns 21, 23, and having single band elements operating in said second frequency band $FB_2$. As is obvious, the antenna arrangement 20 may include any number of columns, every second being of the kind 21, 23 and every second of the kind 22. Using an antenna arrangement as disclosed in FIG. 2, the azimuth angle of a radiated beam may be controlled by imposing a phase shift to a common signal fed to said columns, said phase shift generally being different for each one of the columns, and also for each operating frequency $FB_1$, $FB_2$ (i.e., the azimuth angles of the lobes of the beams radiated by the elements operating in said first frequency band $FB_1$ and said second frequency band $FB_2$, respectively, may be individually controlled). Moreover, these differences can be adjusted by means of adjustable phase shifting means. Preferably, the phase angle difference between adjacent columns of elements will always be mutually the same in order to obtain a wave front substantially in the form of a straight line, wherein the azimuth angle of this wave front can be adjusted by adjusting said phase shifting means.

A problem with the device disclosed in FIG. 2, however, is that it may impose an ambiguity as regarding the direction of arrival (DoA) of a received signal.

Consequently, there exists a need for an antenna arrangement that is able to operate in two or more spaced apart frequency bands, and that is able to determine a correct azimuth angle of received transmissions.

SUMMARY OF THE INVENTION

The principal object of the present invention is to provide an antenna arrangement, of the kind stated in the first paragraph above, wherein the direction of arrival of a received signal can be unambiguously determined.

This object is achieved by an antenna arrangement comprising a first and a third set of antenna elements, being arranged as a first and a third column and aligned along a first and a third symmetry axis, respectively, each column comprising elements being operative in a first frequency band (f1) and elements being operative in a second frequency band (f2). The antenna arrangement further comprises a second set of antenna elements, being arranged as a second intermediate column along a second symmetry axis, said second symmetry axis being parallel to said first and third symmetry axes, and being operative in said second frequency band (f2), wherein the ratio of said second centre frequency (f2) to said first centre frequency (f1) being in the range 1.5 to 3. The antenna arrangement is characterised in that the distance between said first and third symmetry axes is less than or equal to 0.6 times the wavelength of said first centre frequency (f1), and the distance between said second and said first and third symmetry axis, respectively, is less than or equal to 0.6 times the wavelength of said second centre frequency (f2). In an alternative embodiment, said distances are less than or equal to 0.5 times the wavelength of said first and second centre frequencies, respectively.

This has the advantage that it can be ensured that no grating lobes occur, and thereby no ambiguity as regarding the direction of arrival of a received signal is imposed.

Antenna elements in said first and third columns may be arranged such that the distance between the centres of two adjacent elements in a column being operative in said first frequency band (f1) is less than or equal to 0.6 times the wavelength of the centre frequency of said first frequency band. This has the advantage that also the beam steering angle in a direction normal to said antenna arrangement can be unambiguously controlled.

The antenna elements in said second column are arranged such that the distance between the centres of an element in said column and an element of said first and/or third column operative in said second frequency band is substantially equal to $$\frac{\sqrt{2}}{2}\lambda_2,$$

$\lambda_2$ being the wavelength of the centre frequency of said second frequency band. This has the advantage that since the distance between two adjacent symmetry axes is equal, or substantially equal to $$\frac{1}{2}\lambda_2,$$

the distance component in the direction of the symmetry axes between said elements is $$\frac{1}{2}\lambda_2$$

as well, thereby ensuring that also the beam steering angle in the direction normal to said antenna arrangement, i.e., the beam steering angle in a plane through said symmetry axes, can be unambiguously controlled regarding said second frequency band as well if elements of, e.g., said first column and said second column are operated in a zigzag manner.

In use, elements of said third column being operative in said first frequency band may be fed by the signal to said elements of said first column being operative in said first frequency band offset by a phase angle $\alpha$, and said elements of said second column and elements of said third column being operative in said second frequency band may be fed by the signal fed to said elements of said first column being operative in said second frequency band offset by a phase angle $\beta$ and $2\beta$, respectively. This has the advantage that a substantially planar wave front in the desired azimuth direction can be obtained.

BRIEF DESCRIPTION OF THE DRAWINGS

These and other features and advantages of the present invention will appear from the detailed description below, reference being made to the accompanying drawings.

DETAILED DESCRIPTION OF PREFERRED EMBODIMENTS

As was mentioned above, FIG. 2 shows a prior art arrangement for azimuth control of a beam radiated from an antenna arrangement. As also has been disclosed above, the described arrangement suffers from the disadvantage that an ambiguity regarding the direction of arrival of a received signal frequently arises. This is true in the high-frequency band $FB_2$ and in the low-frequency band $FB_1$. The reason for this will be explained in connection to FIG. 3, which shows a portion of an arrangement of FIG. 2 more in detail.

Figure 1:
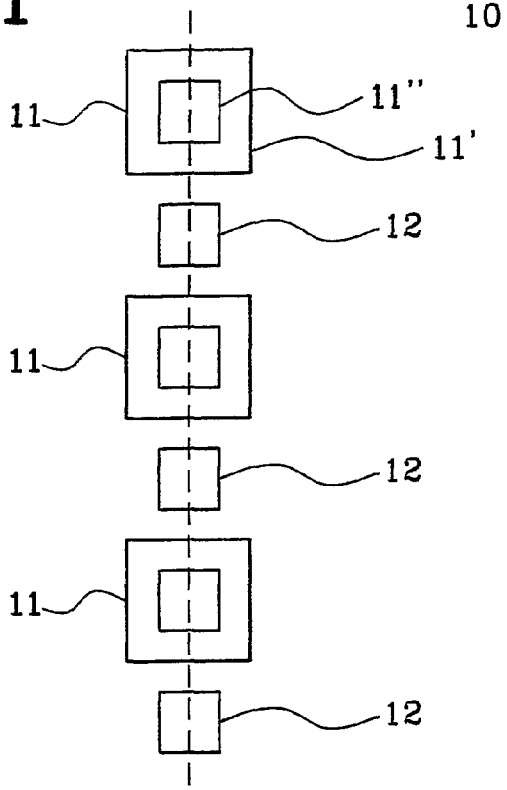
FIG. 1 shows a prior art dual band antenna arrangement.
Figure 2:
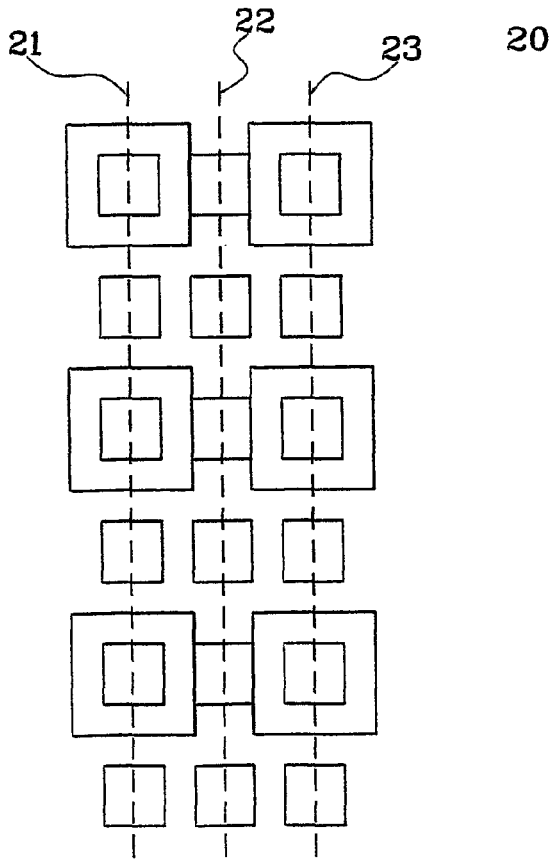
FIG. 2 shows a prior art dual band antenna matrix.
Figure 3:
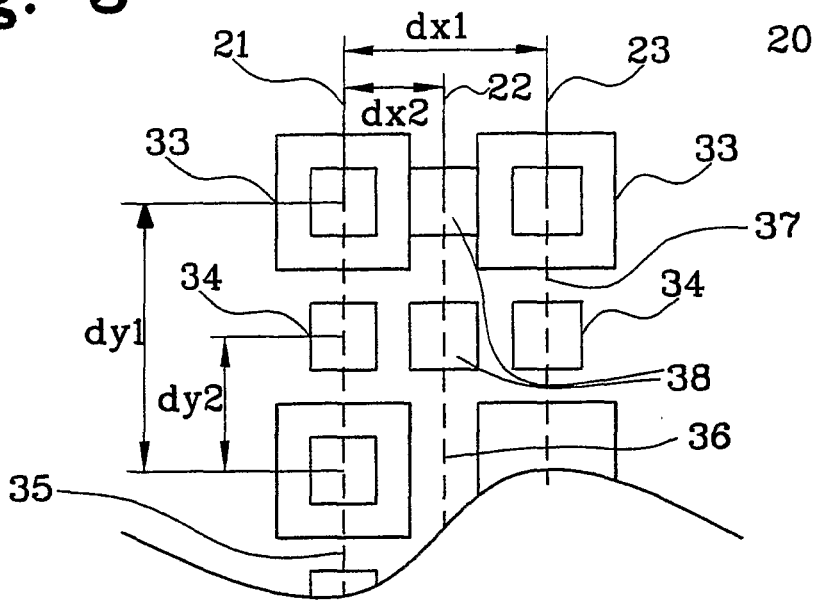
FIG. 3 shows shown the upper portion of the FIG. 2 arrangement.

In FIG. 3 is shown the upper portion of the arrangement of FIG. 2, i.e., the upper portion of an arrangement comprising two columns of elements 21, 23, each comprising a set of single band elements 34, and a set of dual band elements 33, said elements 33, 34 being aligned along parallel symmetry axes 35, 37. Further, an intermediate column 22 of single band antenna elements 38, aligned along a symmetry axis 36, which is parallel to said axes 35, 37, is imposed between the columns 21, 23. The antenna elements are arranged such that the inter-element distance $dy_1$ between two dual band elements 33 within a column is substantially equal to the wavelength $\lambda_1$ of the centre frequency of said first frequency band $FB_1$. The inter-element $dy_2$ distance between two single band elements 34 is substantially equal to the wavelength $\lambda_2$ of the centre frequency of said second frequency band, i.e., when the second centre frequency is about twice said first centre frequency, about half said first distance $dy_1$.

Further, the inter-element distance $dx_1$ between two dual band elements 33 of adjacent dual band columns is also substantially equal to the wavelength $\lambda_1$ of the centre frequency of said first frequency band. Similarly, the inter-element distance $dx_2$ between two single band elements 34 of adjacent columns, is substantially equal to the wavelength $\lambda_2$ of the centre frequency of said second frequency band $FB_2$. (In the figure, the dual band elements 33 of column 21, 23 have been drawn as being arranged edge-to-edge with single band elements 38 of column 22, with the result that the distances $dx_1$ and $dx_2$ as appearing in the figure in fact is about $3\lambda_1/4$ and $3\lambda_2/4$, respectively. However, the elements normally require some spacing, e.g. as shown with regard to inter-element spacing in the y-direction, which in reality increases the inter-element distances $dx_1$ and $dx_2$, e.g. to substantially $\lambda_1$ and $\lambda_2$, respectively).

The inter-element distance according to the above is a result of the fact that the antenna elements have a minimum required physical dimension, i.e., they typically require an area of about $\lambda/2*\lambda/2$, $\lambda$ being the operating frequency of said elements, in order to operate properly. Consequently, elements of the lower frequency band require an area of $\lambda_1/2*\lambda_1/2$, which in a solution according to FIG. 3 means that the inter-element distance in the x-direction by consequence of geometry exceeds $\lambda/2$, e.g., about a factor 2 according to the above when the centre frequency of $FB_2$ is about twice the centre frequency of $FB_1$. Further, even if the elements would be arranged edge-to-edge as in the figure, the inter-element distance $dx_1$ between two dual band elements 33, and the inter-element distance $dx_2$ between two single band elements 34, respectively, will always exceed $\lambda_{element}/2$, which, as will be described in the following, is undesirable.

A problem using an inter-element spacing according to the above is that grating lobes will occur. This will be explained in the following.

Consider an array of elements positioned along a y-axis with a spacing d and measure the angle $\phi$ from the normal x-axis to said array axis. If a beam is steered to a desired angle $\phi_0$ using a uniform phase shift $\beta$ between the elements, it follows that this phase shift $\beta_0$ between consecutive elements along the y-axis is:

$$\beta_0 32 -2\pi d/\lambda*\sin(\phi_0) \quad (1)$$

It is then well-known that additional maxima, or grating lobes, are possible at angles $\phi_{g,m}$ if:

$-2\pi d/\lambda*\sin(\phi_0)+2\pi d/\lambda*\sin(\phi_{g,m})=+/-2\pi m$ for some integer m=1, 2, 3 . . . . The grating lobes will thus occur at:

$$\sin(\phi_{g,m})=\sin(\phi_0)+/-m\lambda/d \quad (2)$$

From (2) the condition of a grating lobe occurring in the visible space, i.e. $0 \leqq \phi_g \leqq 2\pi$ is obtained as:

$$2 \geqq |\sin(\phi_g)-\sin(\phi_0|\geqq \lambda/d \quad (3)$$

or $$d/\lambda \geqq ½ \quad (4)$$

Consequently, when the condition in eq. (4) is met, a signal arriving from $\phi_0$ may cause an ambiguity and it will not be possible to separate it from a signal arriving from $\phi_g$. Similarly, if a signal is transmitted in the direction $\phi_0$, efficiency will be lost by transmission of a grating lobe towards $\phi_g$. As is apparent from the above equations, the inter-element distance d therefore should preferably be $\leqq \frac{1}{2}\lambda$.

If the elements of a single column are controlled so as to vary the vertical beam steering angle, grating lobes usually can be tolerated. The beam steering angle is usually small, i.e., does not deviate much from a direction normal to said array, i.e., the horizontal direction for a vertical array. When this is the case, the grating lobe will occur far from the $\phi_0$ direction (see eq. 2 above). Thereby, it will usually be apparent that signals are received from the lobe in the $\phi_0$ direction and not from a grating lobe. Furthermore, the element factor will suppress these grating lobes.

When it comes to azimuth steering of a beam radiated from said antenna arrangement, however, the beam steering angle usually is substantially greater and therefore these grating lobes will cause the above mentioned ambiguity with regard to the direction of arrival of a received signal. As stated above, this ambiguity is a result of too large an inter-element spacing, whereby grating lobes begins to occur when the inter-element distance exceeds half the wavelength $\lambda$ of the operating frequency of said element. Since the inter-element distance in the x-direction in FIG. 3 is substantially equal to $\lambda_1$ and $\lambda_2$ for the low-frequency band and the high frequency band, respectively, dual band arrangements of the disclosed kind will suffer severely from grating lobes (as can be understood, the above problem do not arise when an antenna array matrix consists of single band element columns only, since these columns can be closely located and thereby an inter-element distance of $\lambda/2$ can be ensured).

Figure 4A:
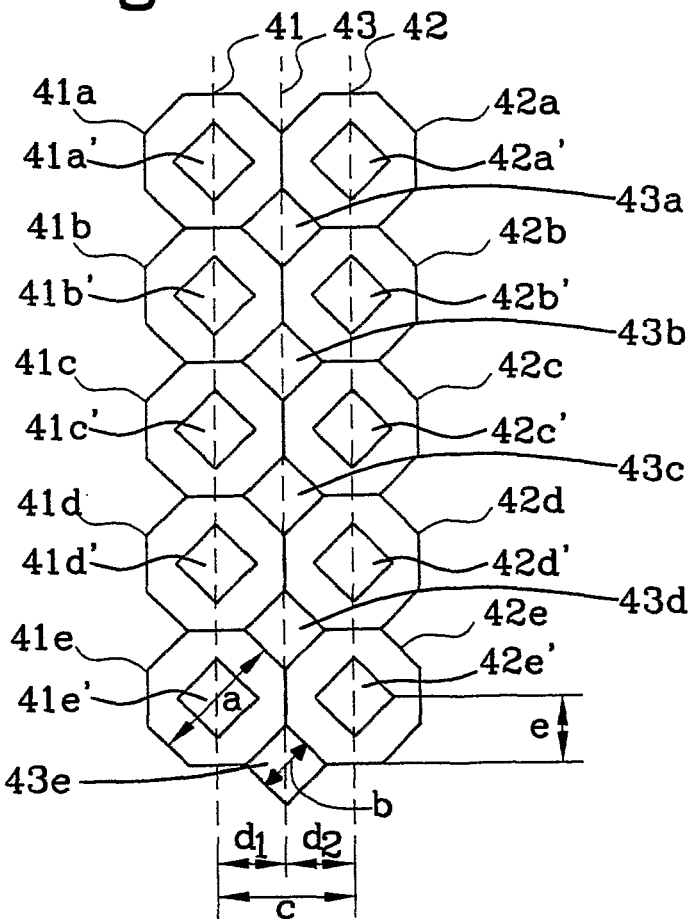
FIG. 4*a* shows a first embodiment of the present invention.

In FIG. 4*a* is shown an arrangement according to the present invention that solves or at least mitigates the described problems.

Figure 4B:
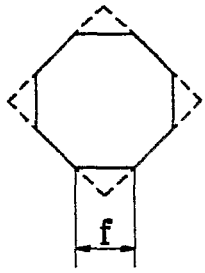
FIG. 4*b-c* show an antenna element according to the present invention.

The disclosed arrangement essentially consists of two adjacently located and parallel columns 41, 42 of antenna elements 41*a-e*, 42*a-e*, wherein each of said elements 41*a-e*, 42*a-e* constitute dual band elements, in this instance antenna elements operating in the GSM 900 band and the GSM 1800 band. Alternatively, the second frequency band could constitute any frequency band from the group: DCS 1800, GSM/EDGE 1800, GSM/EDGE 1900 MHz, UMTS 2100. Each dual band element 41*a-e*, 42*a-e* is similar to the dual band elements of FIG. 3, however with the difference that each element has been rotated about 45 degrees about the centre of the element. This is indicated by the high-frequency portions 41*a*'-41*e*', 42*a*'-42*e*', which obviously are rotated 45 degrees about their centre axis. Further the low-frequency portions of the elements 41*a-e*, 42*a-e* are chamfered so as to produce the octagon shape as is shown in the figure. For purposes of clarity, an element of FIG. 4*a* inscribed in an element of FIG. 3 is shown FIG. 4*b*. This chamfering further produces free spaces 43*a-e*, which are filled by high-frequency elements as is disclosed in the figure. In other words, a column of high-frequency elements is imposed in freed space between the columns 41, 42.

This arrangement of the antenna elements has a number of advantageous effects. Firstly, the distances a of the elements 41*a-e*, 42*a-e* are substantially equal to $\lambda_1/2$, i.e., the low-frequency functionality of the antenna element can be ensured. Secondly, the distances b of the high-frequency elements 43*a-e*, and high frequency portions of the low-frequency elements are substantially equal to $\lambda_2/2$, and consequently, the low-frequency functionality of these antenna elements can be ensured as well. The high-frequency portions of the elements 41*a*'-41*e*', 42*a*'-42*e*'remain unchanged.

Further, the inter-element distance c between elements operating in the frequency band $FB_1$ is $\lambda_1/2$, i.e., it can be ensured that no, or substantially no, azimuth grating lobes will occur during azimuth beam steering of a low-frequency antenna lobe.

Consequently, in operation, elements of the column 42 being operative in said first frequency band $FB_1$ are fed by the signal to corresponding elements of said first column 41 being operative in said first frequency band, however offset by a phase angle $\alpha$. Thereby, the azimuth angle of a beam radiated from said columns can be controlled such that no or substantially no grating lobes will occur, and the lobe direction thereby can be determined in an unambiguous manner.

As also can be seen in the figure, the inter-element distance $d_1$ and $d_2$, respectively, in the x-direction between adjacent elements of said columns 41-43 operating in the high frequency band $FB_2$ is equal, or substantially equal, to $\lambda_2/2$.

Accordingly, in operation, the elements of the column 43 and the elements of column 42 being operative in said second frequency band can be fed by the signal fed to the elements of column 41 being operative in said second frequency band offset by a phase angle $\beta$ and $2\beta$, respectively, having as result that the azimuth angle of a high-frequency beam as well can be controlled such that no or substantially no grating lobes will occur, and thereby also the high-frequency lobe can be determined in an unambiguous manner.

In view of the above, the arrangement disclosed in FIG. 4 provides a substantial inter-element distance improvement as compared to the prior art, which results in a substantially improved operation of the antenna matrix.

As can be seen in the figure, high-frequency elements of adjacent columns are displaced relative to each other in the y-direction by a distance e. This distance e is also equal to $\lambda_2/2$. Consequently, the high frequency elements are not aligned along a horizontal axis. This however, has a negligible impact on the lobe pattern as compared to the impact by an inter element distance exceeding $\lambda/2$.

In FIG. 4 only two dual band columns and a single band column have been disclosed. As is obvious, however, the antenna arrangement matrix can be arranged to include any number of columns, every second being of the kind 41 and every second of the kind 43. It is known to a person skilled in the art that the greater the number of columns, the greater the possibilities of obtaining a desired lobe pattern.

Naturally, the signals fed to the antenna elements of an individual column can be phase shifted so as to vary the vertical beam steering angle, preferably the phase angle difference between adjacent antenna elements will always be mutually the same in order to obtain a wave front substantially in the form of a straight line. The vertical beam steering angle of different columns can be individually controlled, or, alternatively, the vertical beam steering angle of two or more or all columns can be commonly controlled, thus allowing substantially unlimited control possibilities of a radiated beam.

Regarding the vertical tilt of high frequency elements these are preferably operated in a zigzag manner, i.e. elements of column 41 and column 43 are driven as a single array in order to obtained the desired inter-element distance of $\lambda_2/2$ in the y direction, and elements of column 42 and a not shown column, similar to column 43, to the right of column 42, are driven as a single array in the vertical direction. As is understood, the columns are still driven individually regarding lobe steering in the azimuth direction.

The dual band elements may consist of any kind of dual band elements, e.g., as is indicated in the figures, the elements may consist of patch antenna elements, such as antenna elements including a pair of radiating patches, one smaller patch being operative in the upper frequency band and a larger patch being operative in the lower frequency band. The patch antenna elements may constitute single or dual polarization elements.

Figure 5:
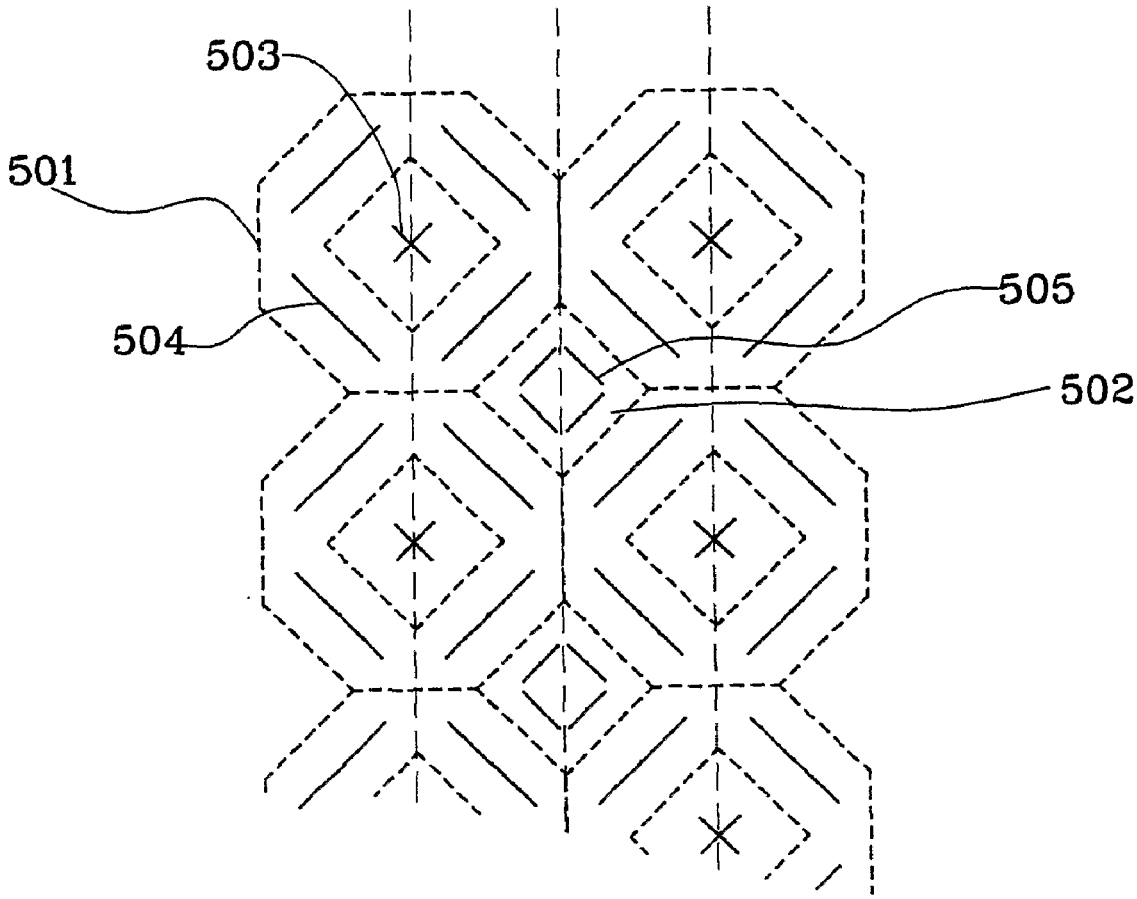
FIG. 5 shows an alternative embodiment according to the present invention.

Another example of usable antenna elements is dipole antenna elements. In FIG. 5 is shown an antenna arrangement corresponding to the antenna arrangement of FIG. 4*a*, wherein dipole antenna elements are used instead of patch antenna elements. The dipole elements have similar requirements regarding the required space of the elements, i.e., the length of the dipoles have to be of a certain length in order to operate properly, i.e., each half of a dipole has to be $\lambda/4$ or a multiple thereof. Consequently, the space requirements of dipole elements are virtually the same as for patch antenna elements, and therefore the present invention is equally valid for dipole antenna solutions. In FIG. 5 is shown a portion of an antenna arrangement similar to FIG. 4*a*, consisting of dual band dipole elements 501 having high band dipoles 504 and low band dipoles 503, and single band dipole elements 502 having high band dipoles 505. Since the dipoles can be arranged on a common ground plane, i.e., common for more than one array, or column, there need not be any visible antenna element boundaries, and therefore these boundaries are schematically indicated by dashed lines.

Figure 4C:
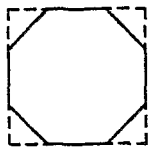

In FIG. 4 the antenna elements 41*a*-41*e*, 42*a*-42*e* have been disclosed as elements of the kind disclosed in FIG. 3 rotated by 45 degrees. These elements could, however, equally well be non-rotated, see FIG. 4*c*. If so, however, the high frequency portion (or patch or dipoles if such antenna elements are used) of said antenna element should be rotated 45 degrees in order to be aligned with the elements of column 43.

In the above description an antenna arrangement has been disclosed wherein the ratio of said second centre frequency (f2) to said first centre frequency (f1) is equal to 2. The present invention, however, is also applicable for other ratios between said frequencies, i.e. ratios ranging from 1.5 to 3. Change of ratio results in a corresponding increase or decrease of the octagon side f, wherein an increasing ratio results in a decreasing distance f, and vice versa.

The invention claimed is:

1. Antenna arrangement for receiving and/or transmitting electromagnetic signals in at least two spaced-apart frequency bands including a first frequency band having a first center frequency (f1) and a second frequency band having a second center frequency (f2), comprising:

a first and third set of antenna elements, being arranged as a first and third column and aligned along a first and third symmetry axis, respectively, each column comprising adjacent dual band elements being operative in said first frequency band (f1) and in said second frequency band (f2), a second set of antenna elements, being arranged as a second intermediate column along a second symmetry axis, said second symmetry axis being parallel to said first and third symmetry axes, and being operative in said second frequency band (f2), the ratio of said second center frequency (f2) to said first center frequency (f1) being in the range 1.5 to 3, wherein the distance between said first and third symmetry axes is less than or equal to 0.6 times the wavelength of said first center frequency (f1), the distance between said second and said first and third symmetry axis, respectively, being less than or equal to 0.6 times the wavelength of said second center frequency (f2).

2. Antenna arrangement according to claim 1, wherein said antenna elements in said first and third columns are arranged such that the distance between the centers of two adjacent elements in a column being operative in said first frequency band (f1) is less than or equal to one half the wavelength of the center frequency of said first frequency band.

3. Antenna arrangement according to claim 1 wherein said antenna elements in said first and third columns are arranged such that the distance between the centers of two adjacent elements in a column being operative in said second frequency band (f2) is less than or equal to the wavelength of the center frequency of said second frequency band.

4. Antenna arrangement according to claim 1, wherein said antenna elements in said second column are arranged such that the distance between the centers of two adjacent elements in said column is less than or equal to the wavelength of the center frequency of said second frequency band.

5. Antenna arrangement according to claim 4, wherein said antenna elements in said second column are arranged such that the distance between the centers of an element in said column and an element of said first and/or third column operative in said second frequency band is substantially equal to $$\frac{\sqrt{2}}{2}\lambda_2,$$

$\lambda_2$ being the wavelength of the center frequency of said second frequency band.

6. Antenna arrangement according claim 1, wherein said antenna elements in said second column are arranged such that the distance in symmetry axis direction between the center of an element in said second column and the center of an adjacent element in said first or third column is substantially equal to 0.6 times the wavelength of said second center frequency (f2).

7. Antenna arrangement according to claim 1, wherein said antenna elements in said second column are arranged such that the distance in symmetry axis direction between the center of an element in said second column and the center of an adjacent element in said first or third column is substantially equal to 0.5 times the wavelength of said second center frequency (f2).

8. Antenna arrangement according to claim 1, wherein said antenna elements of the first, second and third column are patch antenna elements.

9. Antenna arrangement according to claim 1, wherein said antenna elements are dipole antenna elements.

10. Antenna arrangement according to claim 1, wherein said symmetry axes are substantially vertically oriented.

11. Antenna arrangement according to claim 1, wherein said second center frequency (f2) is substantially twice said first center frequency (f1).

12. Antenna arrangement according to claim 1, wherein said symmetry axes are arranged on a common plane.

13. Antenna arrangement according to claim 1, wherein said antenna elements being operative in said first frequency band (f1) have a substantially octagonal design.

14. Antenna arrangement according to claim 1, wherein, in use, a first signal is fed to said elements of said first column being operative in said first frequency band, and a second signal is fed to said elements of said first column being operative in said second frequency band, elements of said third column being operative in said first frequency band are fed by the first signal offset by a phase angle $\alpha$, and said elements of said second column and elements of said third column being operative in said second frequency band are fed by the second signal offset by a phase angle $\beta$ and $2\beta$, respectively.

15. Antenna arrangement according to claim 1, wherein the beam angle of a beam radiated from said antenna arrangement is arranged to be remotely controlled.

16. Cellular mobile communication system, comprising an antenna arrangement according to claim 1.

17. Antenna arrangement according to claim 1, wherein portions of adjacent antenna elements being operative in said first frequency band (f1) have a chamfered design creating space for elements of said second column being operative in said second frequency band.

* * * * *